US007052198B2

(12) United States Patent
Sasaki

(10) Patent No.: US 7,052,198 B2
(45) Date of Patent: May 30, 2006

(54) STICK-SHAPED COSMETIC MATERIAL FEEDING CONTAINER

(75) Inventor: Arata Sasaki, Kita-ku (JP)

(73) Assignee: Tokiwa Corporation, (JP)

( * ) Notice: Subject to any disclaimer, the term of this patent is extended or adjusted under 35 U.S.C. 154(b) by 0 days.

(21) Appl. No.: 11/043,133

(22) Filed: Jan. 27, 2005

(65) Prior Publication Data

US 2005/0180805 A1 Aug. 18, 2005

(30) Foreign Application Priority Data

Feb. 17, 2004 (JP) ..... 2004-040392

(51) Int. Cl.
*B43K 21/08* (2006.01)

(52) U.S. Cl. ..... 401/75; 401/55; 401/68

(58) Field of Classification Search ..... 401/75, 401/70, 77, 68, 67, 69, 72, 78, 116, 87, 86
See application file for complete search history.

(56) References Cited

U.S. PATENT DOCUMENTS 6,048,122 A * 4/2000 Ohba ..... 401/55
6,309,121 B1 * 10/2001 Ohba ..... 401/78
6,588,957 B1 * 7/2003 Ohba ..... 401/75
6,769,826 B1 * 8/2004 Ohba ..... 401/75
2002/0168213 A1 * 11/2002 Yamamoto ..... 401/88

FOREIGN PATENT DOCUMENTS

JP 09-028457 2/1997

* cited by examiner

*Primary Examiner*—Khoa D. Huynh
(74) *Attorney, Agent, or Firm*—Bacon & Thomas PLLC

(57) ABSTRACT

A stick-shaped cosmetic material feeding container, wherein a forward and backward moving hole (8*d*) of a front tube (8) is formed in a noncircular shape close to a cosmetic material (M) and a support pieces (9*c*), a gap between the cosmetic material (M) and the hole (8*d*) is made small, a space in a side of the cosmetic material from a packing (10) is made airtight to a space in a rear end side from the packing (10) by the packing (10), which is attached to a rear side from the support piece (9*c*), copies a shape of the hole (8*d*) and is pressure-contacted with the hole (8*d*) and is pressure-contacted with the hole (8*d*), the front tube (8) and a support rod (9) are rotated synchronously, and the support rod (9) is moved in the hole (8*d*) by a relative rotation between the front tube (8) and the main body tube (7).

4 Claims, 13 Drawing Sheets

STICK-SHAPED COSMETIC MATERIAL FEEDING CONTAINER

TECHNICAL FIELD

The present invention relates to a stick-shaped cosmetic material feeding container.

BACKGROUND ART

Conventionally, there has been known a stick-shaped cosmetic material feeding container which feeds a volatile stick-shaped cosmetic material and prevents the stick-shaped cosmetic material from being volatilized (refer, for example, Japanese Unexamined Patent Publication No. 9-28457). In this stick-shaped cosmetic material feeding container, a support rod with a recess portion formed in a circular cross sectional shape is provided in a leading end of a columnar shaft body portion, a rear end portion of the stick-shaped cosmetic material is fitted and supported to the recess portion, the support rod is received so as to freely move forward and backward in a forward and backward moving hole provided in a front tube and having a circular cross sectional shape, and an O-ring pressure contacted with the forward and backward moving hole and sliding in an airtight manner is fitted to a rear side of the support rod from the stick-shaped cosmetic material. Accordingly, a space in a side of the stick-shaped cosmetic material from the O-ring is made airtight by the O-ring with respect to a space in a rear end side from the O-ring, and the front tube and the support rod are made synchronously rotatable on the basis of a sliding resistance in a rotational direction of the O-ring with respect to the front tube (the support rod is prevented from rotating). When a main body tube rotatably connected to a rear end side of the front tube and the front tube are relatively rotated, and the support rod moves forward and backward in the forward and backward moving hole in accordance with a motion of an engagement mechanism constituted by a male screw provided on an outer peripheral surface in the rear end portion of the support rod and a female thread provided on an inner peripheral surface of the main body tube, whereby the stick-shaped cosmetic material comes out and return from a leading end of the front tube.

However, in the stick-shaped cosmetic material feeding container mentioned above, there is a risk that the stick-shaped cosmetic material is broken by an external force due to, for example, drop of the container or the like. Further, it is hard to securely rotate the front tube and the support rod synchronously on the basis of the sliding resistance by the circular O-ring, so that the support rod can not move forward and backward in the forward and backward moving hole, and there is a case that a function serving as the stick-shaped cosmetic feeding container cannot be achieved.

SUMMARY OF THE INVENTION

The present invention is made in order to solve the problem mentioned above, and an object of the present invention is to provide a stick-shaped cosmetic material feeding container in which a stick-shaped cosmetic material is prevented from being broken due to an external force application caused by drop of the container or the like, and the stick-shaped cosmetic material is well prevented from being volatilized, whereby an excellent quality can be secured, and a front tube and a support rod are securely rotated synchronously so as to sufficiently achieve a function serving as a stick-shaped cosmetic material feeding container.

In accordance with the present invention, there is provided a stick-shaped cosmetic material feeding container comprising:

a support rod supporting a rear end portion of a stick-shaped cosmetic material;

a front tube receiving the stick-shaped cosmetic material and the support rod in a forward and backward moving hole so as to freely move forward and backward;

a main body tube rotatably connected to a rear end side of the front tube;

the front tube and the support rod being synchronously rotatable, the support rod being moved forward and backward in the forward and backward moving hole in accordance with a motion of an engagement mechanism on the basis of a relative rotation of the front tube and the main body tube, and thereby the stick-shaped cosmetic material coming out and returning from a leading end of the front tube, wherein the support rod is provided with a plurality of support pieces which are arranged apart from each other in a peripheral direction and support a rear end portion of the stick-shaped cosmetic material, the forward and backward moving hole is continuously provided with grooves capable of forward and backward moving the support pieces at a plurality of positions in the periphery of a through hole capable of forward and backward moving the stick-shaped cosmetic material, an inner surface of the forward and backward moving hole is formed in a noncircular shape close to the stick-shaped cosmetic material and the support pieces, the support rod is provided with a packing attached to a rear side from the support pieces, and an outer shape of the packing is formed in a shape copying the noncircular shape of the forward and backward moving hole so as to be pressure contacted with the forward and backward moving hole.

In accordance with the stick-shaped cosmetic material feeding container mentioned above, the forward and backward moving hole of the front tube, along which the stick-shaped cosmetic material and a plurality of support pieces move forward and backward, is formed in the noncircular shape which is close to the stick-shaped cosmetic material and the support pieces. Accordingly, a gap of the stick-shaped cosmetic material with respect to the forward and backward moving hole (a surface between the grooves of the through hole) is made smaller, and the stick-shaped cosmetic material is supported by the forward and backward moving hole (the surface between the grooves of the through hole) before being bent and broken so as to prevent the stick-shaped cosmetic material from being broken due to bending. Further, on the basis of the packing which is attached to the rear side of the support rod from the support pieces, has the outer shape copying the shape of the noncircular forward and backward moving hole and is pressure contacted with the forward and backward moving hole, the space from the packing to the stick-shaped cosmetic material side is made airtight with respect to the space from the packing to the rear end side so as to well prevent the stick-shaped cosmetic material from being volatilized, the front tube and the support rod are securely rotatable synchronously, and the support rod is well moved forward and backward in the forward and backward moving hole while the packing is in slide contact in an airtight manner due to the relative rotation of the front tube and the main body tube, whereby the stick-shaped cosmetic material well comes out and return from the leading end of the front tube.

In the case that an inner peripheral surface of the packing and an outer peripheral surface of the support rod are structured in such a shape that when the support rod reaches a forward movement limit or a backward movement limit, the packing and the support rod run idle with a predetermined resistance feeling on the basis of the relative rotation mentioned above, the synchronous rotation of the front tube and the support rod are cancelled so as to be prevented from being broken on the basis of an unreasonable rotation, and a predetermined resistance feeling is applied, whereby it is possible to sense that the support rod reaches the forward movement limit or the backward movement limit.

Further, in the case that the support rod is separated into a member in which the support pieces are arranged and a member to which the packing is attached, and is structured such that both the members are connected rotatably, a rotational torque applied to the packing due to the relative rotation mentioned above is shut off with respect to the support pieces, and it is possible to prevent a torsional force from being applied to the stick-shaped cosmetic material supported by the support pieces.

As mentioned above, in accordance with the stick-shaped cosmetic material feeding container on the basis of the present invention, it is possible to provide the stick-shaped cosmetic material feeding container in which the stick-shaped cosmetic material is prevented from being broken due to the external force application caused by drop of the container or the like, and the stick-shaped cosmetic material is well prevented from being volatilized, whereby an excellent quality can be secured, and the front tube and the support rod are securely rotated synchronously so as to sufficiently achieve the function serving as the stick-shaped cosmetic material feeding container.

DESCRIPTION OF THE PREFERRED EMBODIMENTS

Figure 1:
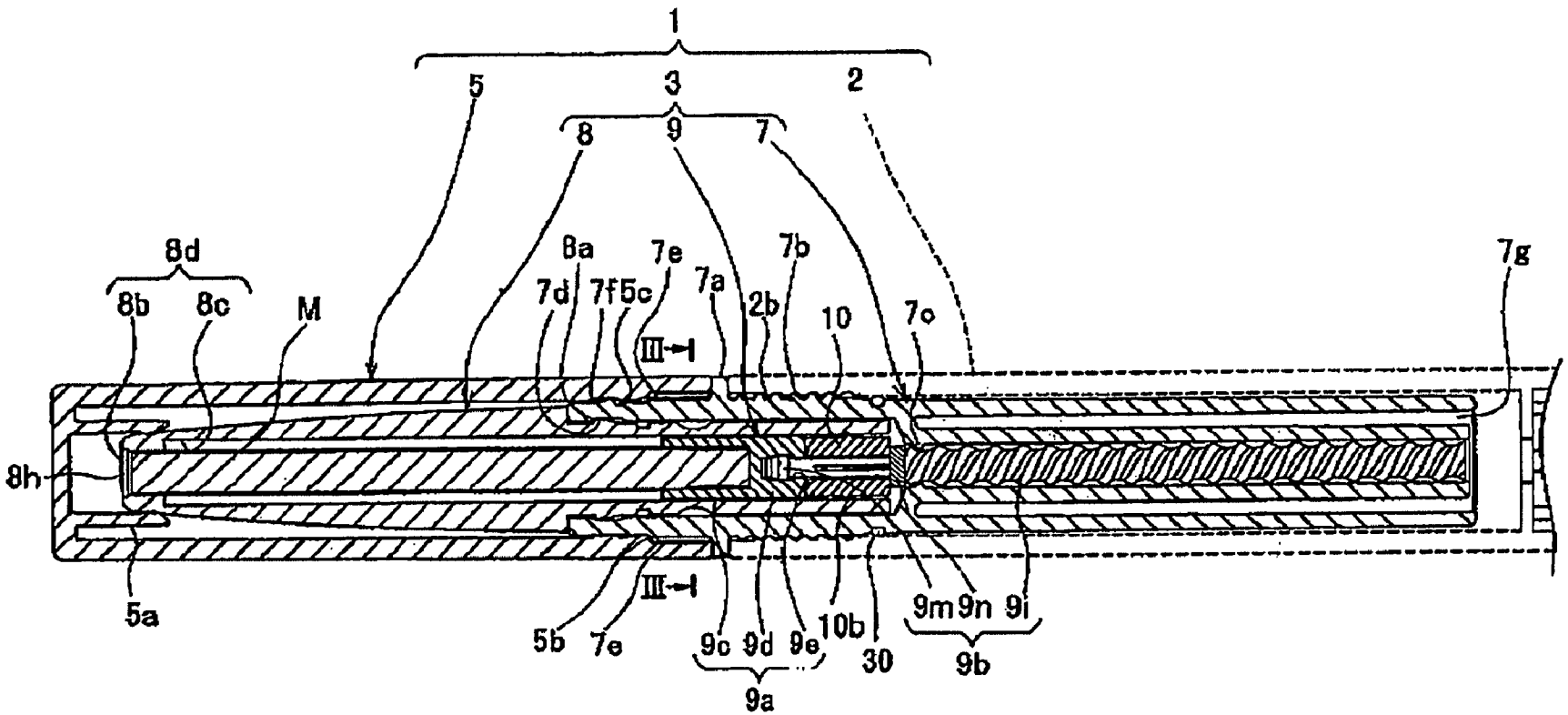
FIG. 1 is a longitudinal sectional view showing a stick-shaped cosmetic material feeding container in accordance with a first embodiment of the present invention.
Figure 2:
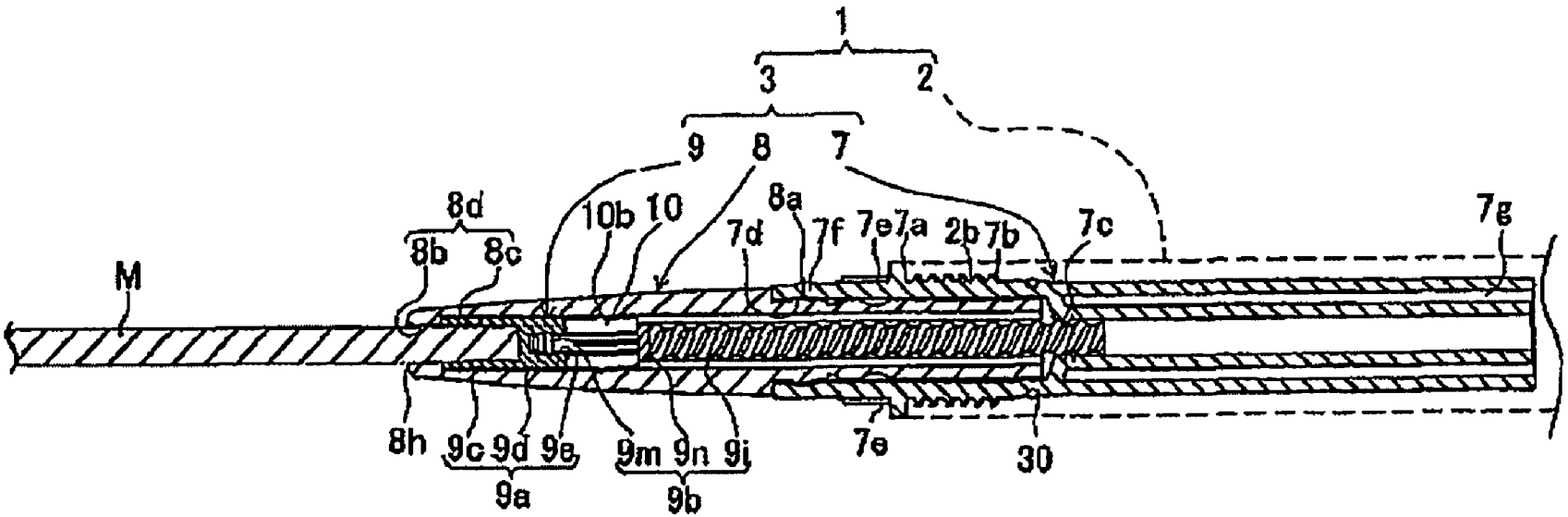
FIG. 2 is a longitudinal sectional view showing a state in which a cap of the stick-shaped cosmetic material feeding container shown in FIG. 1 is taken off, and a view showing a state in which the stick-shaped cosmetic material reaches a forward movement limit.
Figure 3:
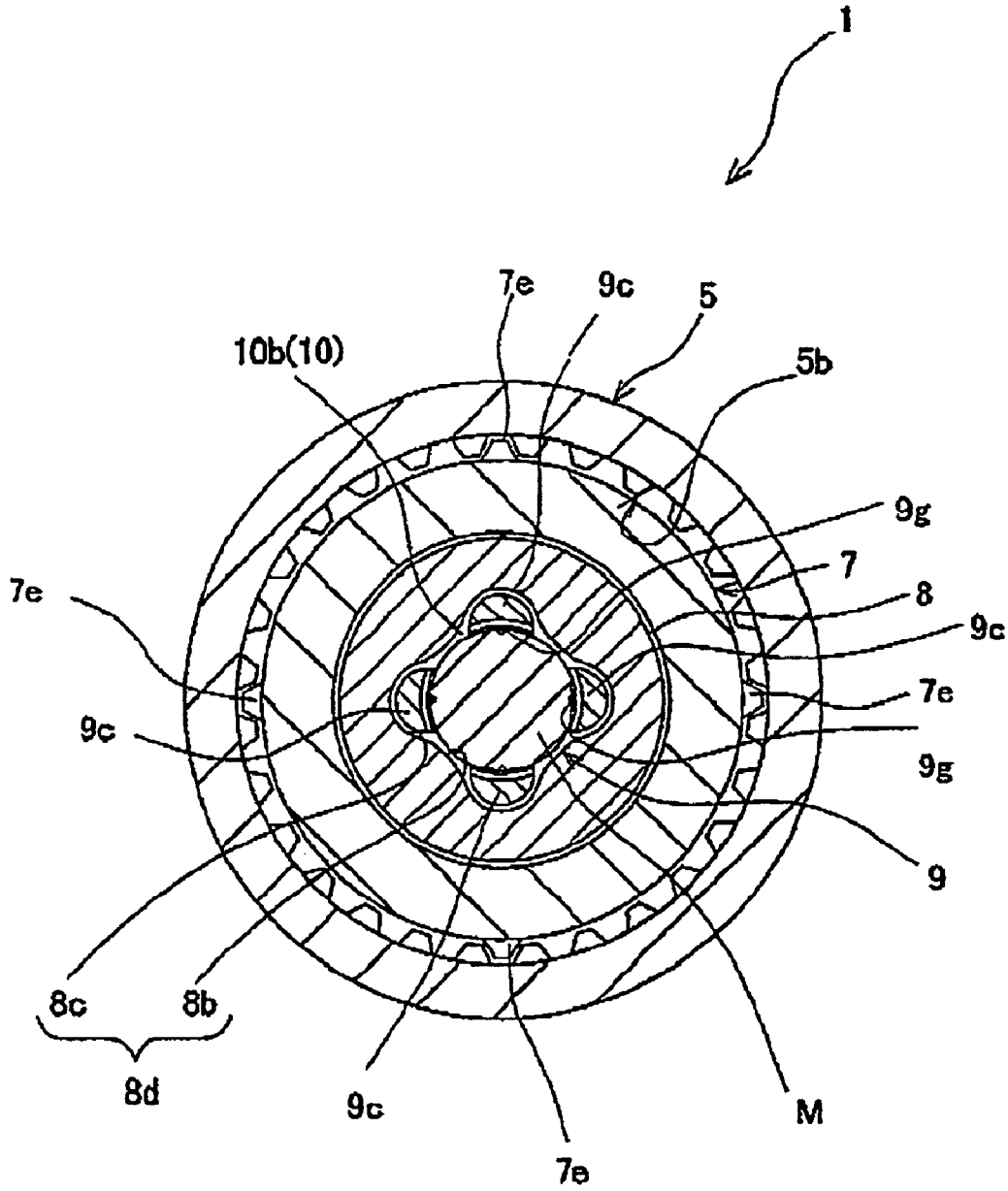
FIG. 3 is a view as seen from a line III—III in FIG. 1.
Figure 4:
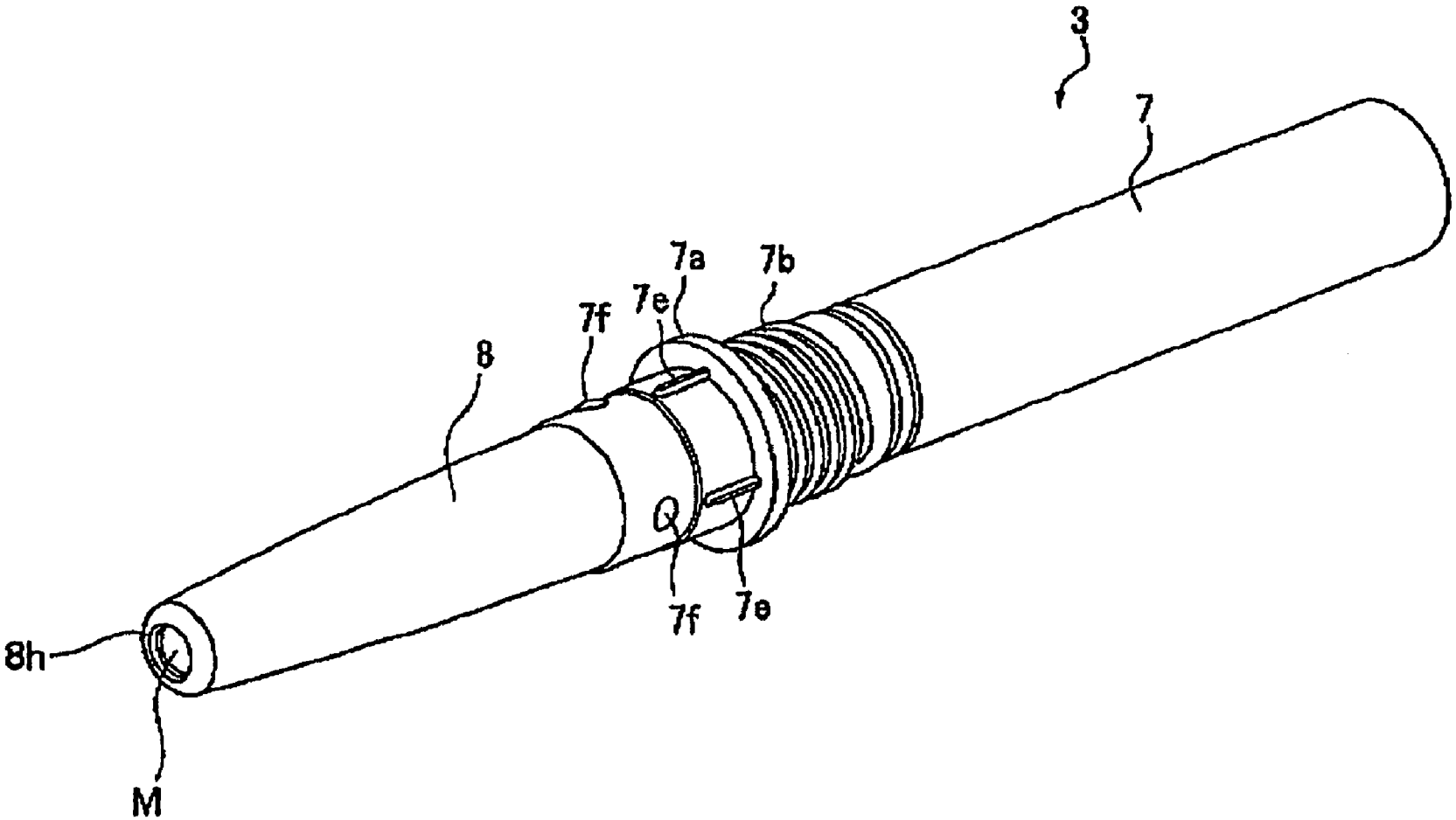
FIG. 4 is a perspective view showing a stick-shaped cosmetic material cartridge in FIGS. 1 and 2.
Figure 5:
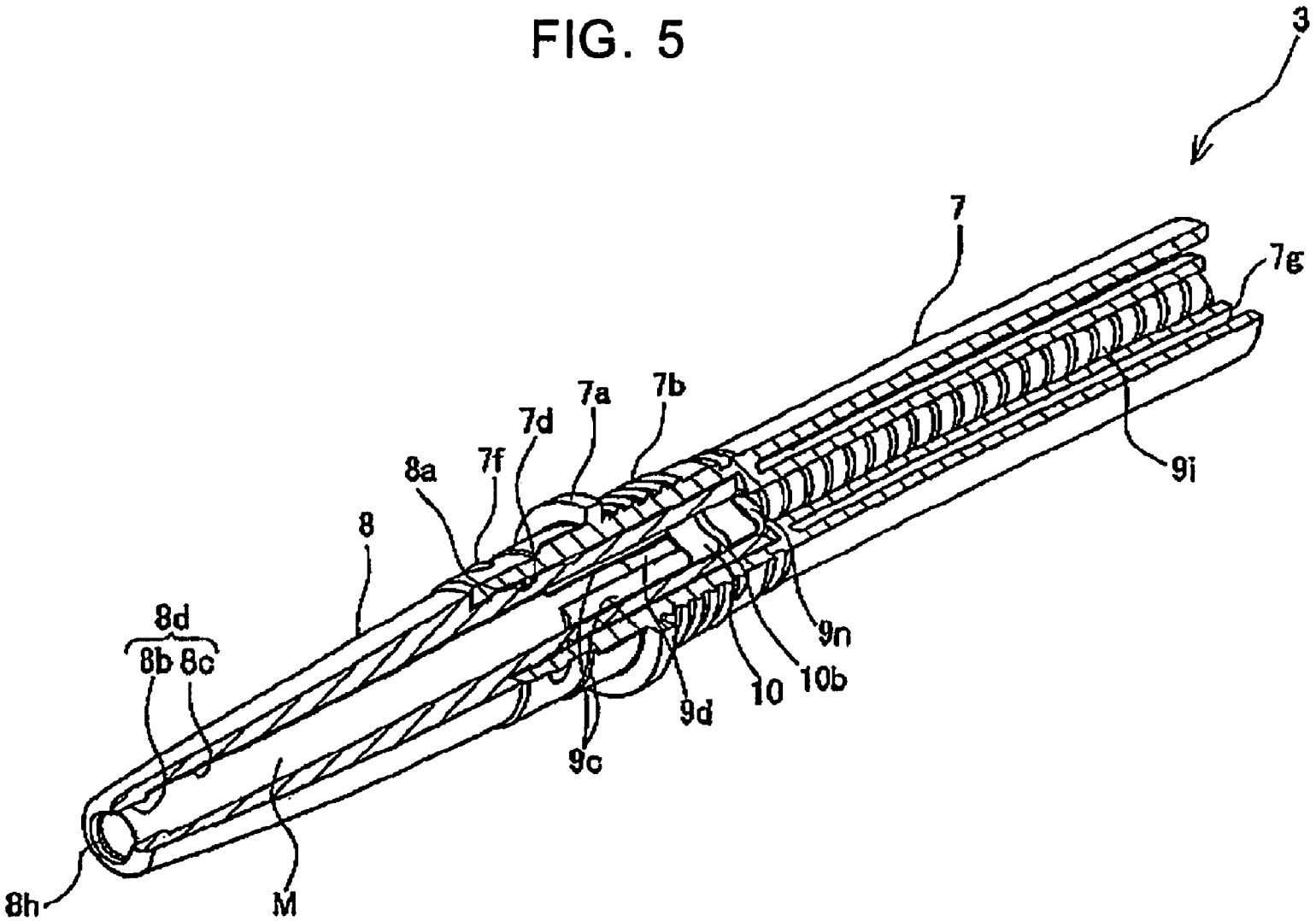
FIG. 5 is a partly cutaway perspective view of the stick-shaped cosmetic material cartridge shown in FIG. 4.
Figure 10:
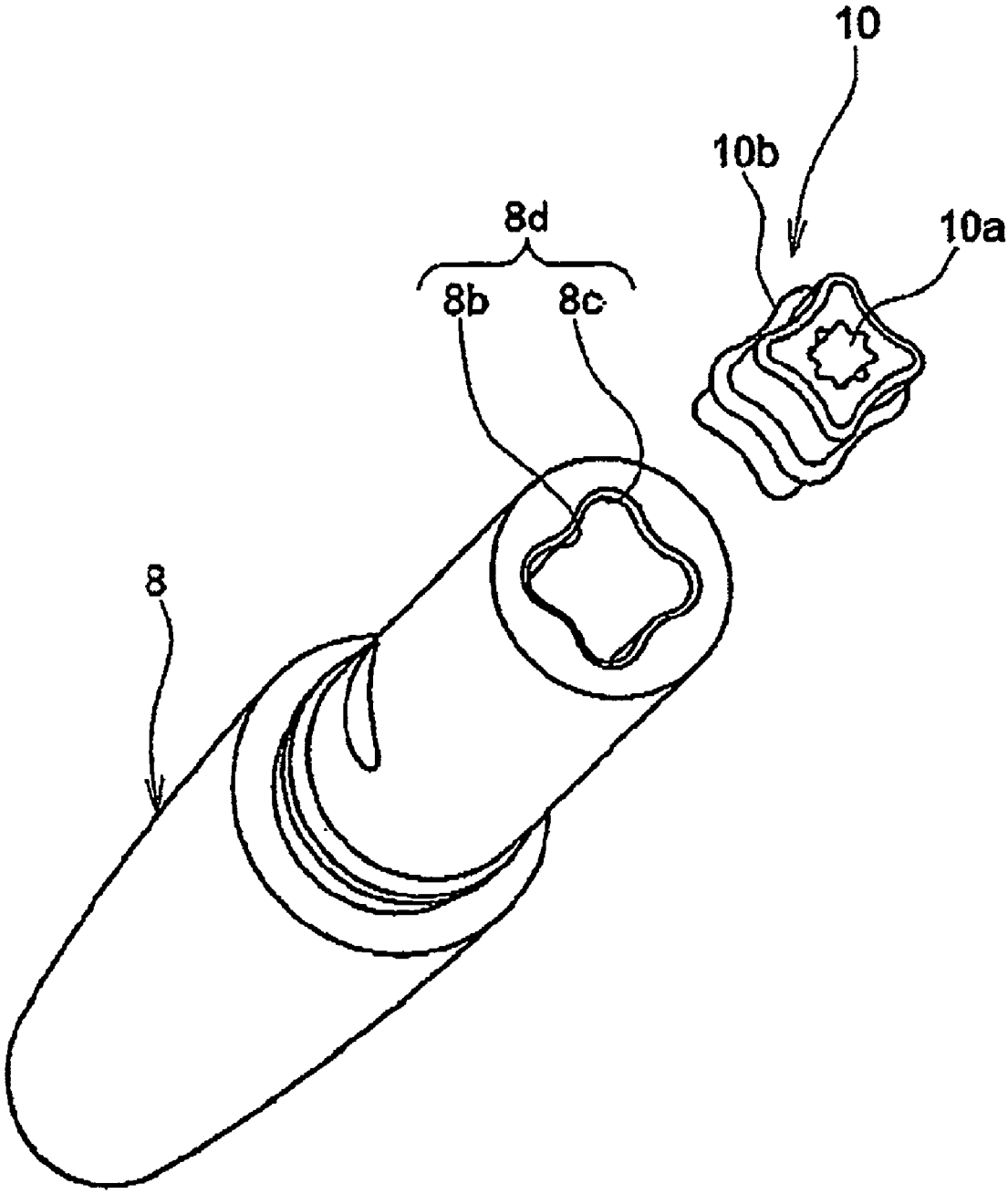
FIG. 10 is an exploded perspective view of a front tube and a packing in FIG. 2.
Figure 11:
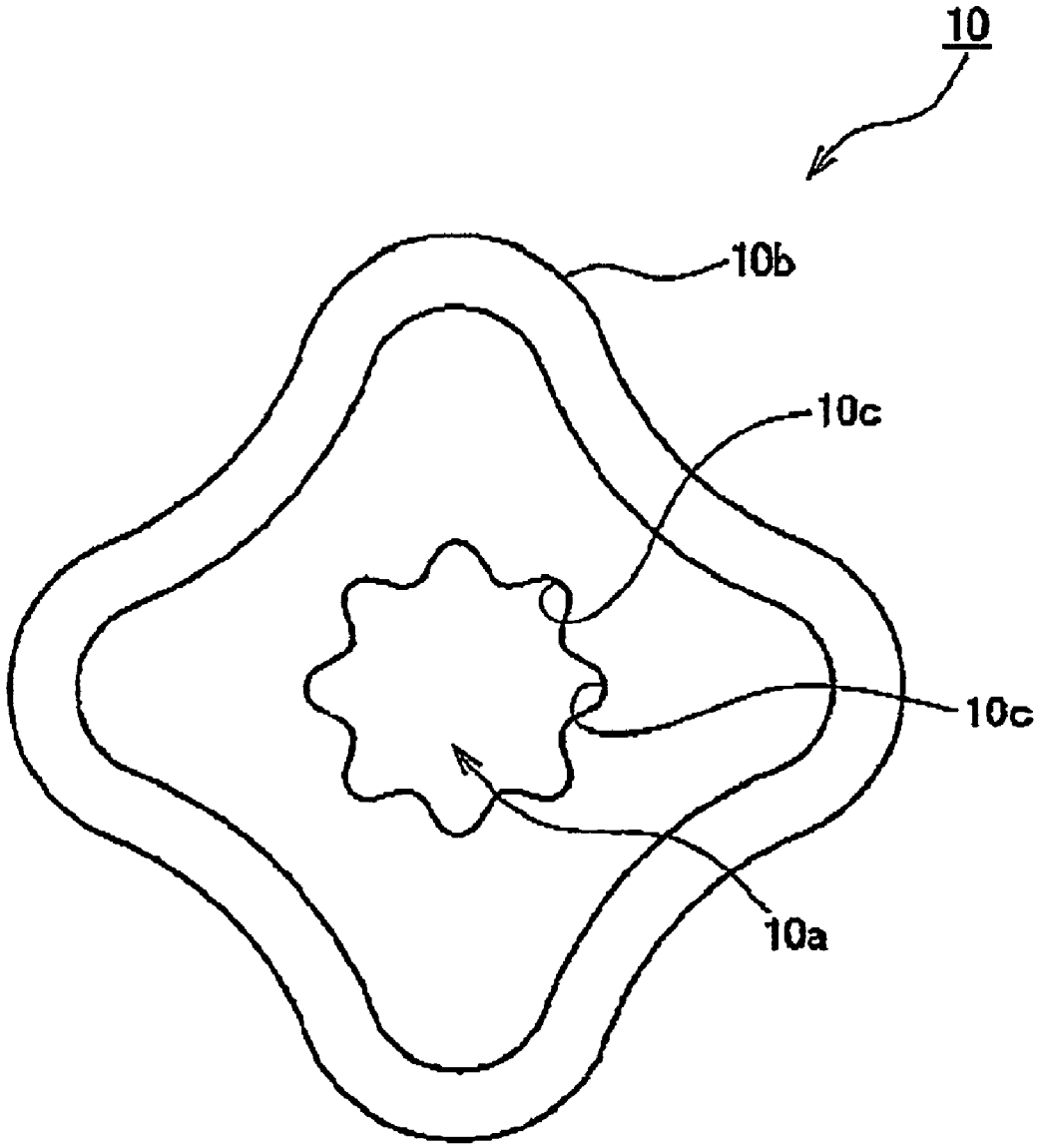
FIG. 11 is a front view of the packing in FIG. 10.

A description will be given below of a preferable embodiment of a stick-shaped cosmetic material feeding container in accordance with the present invention with reference to FIGS. 1 to 13. In this case, in each of the drawings, the same reference numerals are attached to the same elements, and an repeated description will be omitted. FIGS. 1 to 11 are views showing a stick-shaped cosmetic material feeding container in accordance with a first embodiment of the present invention, in which FIGS. 1 to 3 are views showing the stick-shaped cosmetic material feeding container, FIGS. 4 and 5 are views showing a stick-shaped cosmetic material cartridge, FIGS. 6 to 9 are views showing a support rod, FIG. 10 is a view showing a front tube and a packing, FIG. 11 is a view showing the packing. The stick-shaped cosmetic material feeding container in accordance with the present embodiment is constituted by a stick-shaped cosmetic material feeding container in which an entire shape is formed in an elongated round bar shape like as a pen (a stick shape), various solid stick-shaped cosmetic materials are received, for example, an eyeliner, an eyebrow, a lip liner and the like, and a user can appropriately take out and return it on demand.

As shown in FIG. 1, a stick-shaped cosmetic material feeding container 1 is detachably provided with a stick-shaped cosmetic material cartridge 3 receiving a stick-shaped cosmetic material M in a leading end side (a left side in the drawing) of a receiving container 2 illustrated by a dotted line. When relatively rotating a front tube 8 constituting the stick-shaped cosmetic material cartridge 3 and the receiving container 2, the stick-shaped cosmetic material M comes out and return from an opening 8*h* in a leading end of the front tube 8. On the other hand, when detaching the stick-shaped cosmetic material cartridge 3 from the receiving container 2 and relatively rotating the front tube 8 and a main body tube 7 constituting the stick-shaped cosmetic material cartridge 3, the stick-shaped cosmetic material M comes out and return from the leading end of the front tube 8. Accordingly, the stick-shaped cosmetic material cartridge 3 can be independently used as the stick-shaped cosmetic material feeding container. A cap 5 covering a portion protruding outward from the receiving container 2 for preventing the stick-shaped cosmetic material M from being volatilized (being described in detail later) is detachably mounted to a front end side of the stick-shaped cosmetic material feeding container 1.

As shown in FIGS. 1 and 2, the receiving container 2 is formed in a closed-end cylindrical shape, and a space receiving a rear portion side of the stick-shaped cosmetic material cartridge 3 is defined within the tube. A female thread 2*b* for detachably mounting the stick-shaped cosmetic material cartridge 3 is formed in an inner peripheral surface close to the opening in the receiving container 2, and an O-ring (an elastic body) 30 for giving a finish feeling of fastening at a time of attaching the stick-shaped cosmetic material cartridge 3 is provided near a rear side of the female thread 2*b*.

The stick-shaped cosmetic material cartridge 3 is provided with the main body tube 7 having a cylindrical shape with collar, the front tube 8 in which a rear portion side is inward inserted to the main body tube 7 and a leading end side protrudes from a leading end of the main body tube 7, and a support rod 9 which is received within the front tube 8 and the main body tube 7, extends in an axial direction and moves forward and backward while holding the stick-shaped cosmetic material M in a leading end.

The main body tube 7 has an annular collar portion 7*a* in an outer peripheral surface at a position which is about one fourth of an entire length apart from the leading end, and a male screw 7*b* in an outer peripheral surface slightly close to the rear end side from the collar portion 7*a*, as shown in FIGS. 1, 2, 4 and 5. A portion close to the rear end portion from the collar portion 7*a* is made smaller than an inner diameter of the receiving container 2 so as to be freely inserted. The main body tube 7 is provided with a protrusion 7*e* for connecting the cap 5 so as to be non-rotatable and movable in an axial direction at four uniformly arranged positions in a peripheral direction along an axial direction, as shown in FIGS. 1 to 5, on an outer peripheral surface in the leading end side of the collar portion 7*a*, and is provided with a protruding portion (a so-called dowel) 7*f* for detachably locking the cap 5 in the axial direction at three uniformly arranged positions in the peripheral direction, on the outer peripheral surface close to the front end side from the protrusion 7*e*.

The main body tube 7 is detachably mounted to the receiving container 2, as shown in FIGS. 1 and 2, in a state in which the rear end portion side from the collar portion 7*a* is inward inserted to the receiving container 2, the male screw 7*b* of the main body tube 7 is engaged with the female thread 2*b* of the receiving container 2, and the rear end surface of the collar portion 7*a* is brought into contact with the leading end surface of the receiving container 2.

The main body tube 7 is structured such that about one third of the entire length close to the leading end is formed as a large-diameter hole so as to receive the rear end portion of the front tube 8, a range from the large-diameter hole to the rear end surface is formed as a small-diameter hole, an engagement projection 7*c* structuring an engagement mechanism of the forward and backward moving mechanism of the support rod 9 is formed in a leading end of the small-diameter hole, and an annular groove portion 7*d* for attaching the front tube 8 is formed at a position close to the leading end of the large-diameter hole, as shown in FIGS. 1, 2 and 5.

Further, the main body tube 7 is provided with an annular depressed groove 7*g* which is depressed from the rear end surface and extends to a periphery of the engagement projection 7*c*. It is possible to uniformize a thickness (small thickness) around the large-diameter hole and a thickness around the small-diameter hole by the depressed groove 7*g*, it is possible to prevent a shrink (including a void) which may be generated due to a great thickness difference from being generated, and the small-diameter hole of the main body tube 7 and the engagement projection 7*c* are accurately molded by resin.

The front tube 8 is formed in a stepped cylindrical shape which is provided with a large-diameter portion serving as a finger grip portion in a leading end side protruding from the leading end of the main body tube 7, and a small-diameter portion continuously provided in a rear end of the large-diameter portion via an outer peripheral step surface with an outer peripheral surface having a small diameter. The large-diameter portion is formed in a taper shape in which an outer diameter is narrowed gradually toward the leading end, and the small-diameter portion is made smaller than the inner diameter of the main body tube 7 so as to be freely inserted, and is provided with an annular protruding portion 8*a* on an outer peripheral surface close to an outer peripheral step surface.

The front tube 8 is structured such that the small-diameter portion is inward inserted to the main body tube 7, the outer peripheral step surface is brought into contact with the leading end surface of the main body tube 7, and the annular protruding portion 8*a* is engaged with the annular groove portion 7*d* of the main body tube 7, whereby the front tube 8 is attached to the main body tube 7 so as to be relatively rotatable and unmovable in the axial direction.

In other words, the main body tube 7 and the front tube 8 are connected so as to be relatively rotatable, and the main body tube 7 and the receiving container 2 are made integral in accordance with screw engagement. Accordingly, the front tube 8 and the receiving container 2 are connected so as to be relatively rotatable via the main body tube 7, and the engagement between the main body tube 7 and the receiving container 2 is cancelled by the relative rotation between the receiving container 2 and the main body tube 7.

As shown in FIGS. 1 to 3 and 5, the front tube 8 is provided with a through hole 8*b* which extends from the leading end to the rear end and allows the stick-shaped cosmetic material M to move forward and backward, and is continuously provided with a groove 8*c* allowing a support piece 9*c* mentioned below to move forward and backward from a portion close to the leading end to the rear end, at a plurality of positions around the through hole 8*b*, and a forward and backward moving hole 8*d* is structured by the through hole 8*b* and the groove 8*c* (described in detail later).

Figure 7:
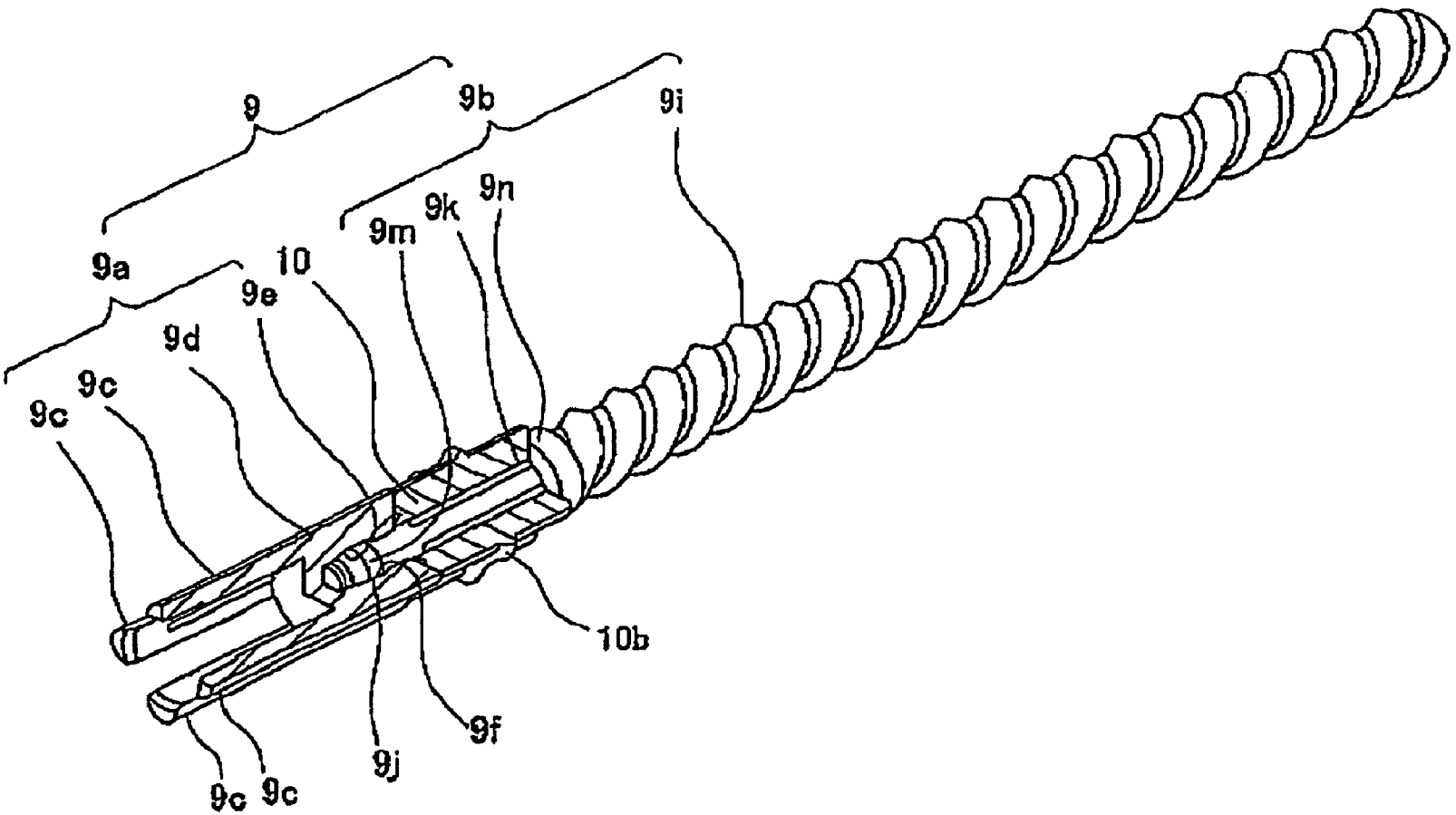
FIG. 7 is a partly cutaway perspective view of the support rod shown in FIG. 6.

The support rod 9 received in the front tube 8 and the main body tube 7 is provided with a support portion 9*a* received in the front tube 8, and a shaft body portion 9*b* mainly received in the main body tube 7, as shown in FIGS. 1, 2 and 7.

The support portion 9*a* is structured such as to support the rear end portion of the stick-shaped cosmetic material M and move forward and backward the forward and backward hole 8*d*, is provided with a base portion 9*d* with which the rear end surface of the stick-shaped cosmetic material M is brought into contact, and a plurality of (four in the present embodiment) support pieces 9*c* supporting the rear end portion of the stick-shaped cosmetic material M, as shown in FIGS. 1 to 3 and FIGS. 5 to 7, and is formed as an integrally molded elastic product, for example, made of a resin or the like.

The base portion 9*d* is formed in a short columnar shape as shown in FIGS. 1, 2 and 5 to 7, is structured in a shape approximately coinciding with the columnar stick-shaped cosmetic material M, is provided with a recess portion 9*e* allowing a connection portion 9*m* in the leading end of the shaft body portion 9*b* to be inserted thereto, as shown in FIG. 7, in a rear portion of the base portion, and is provided with an annular groove portion 9*f* for rotatably attaching the connection portion 9*m* of the shaft body portion 9*b* in an inner peripheral surface of the recess portion 9*e*.

Figure 6:
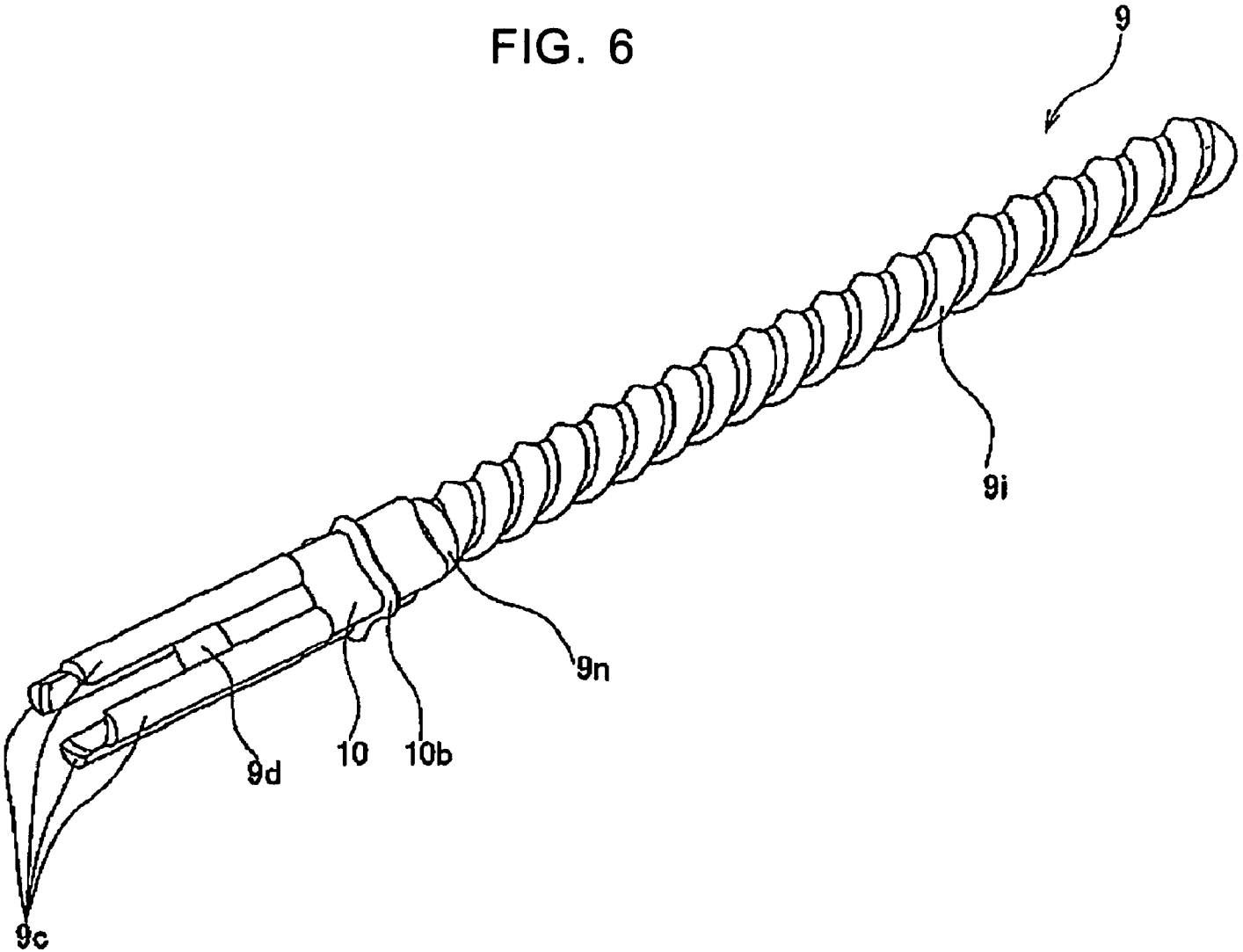
FIG. 6 is a perspective view showing a support rod in FIG. 5.

The support piece 9*c* is provided at four uniformly arranged positions (at an interval of 90 degree) in the peripheral direction of the outer peripheral surface of the base portion 9*d* so as to protrude toward the leading end side of the front tube 8, as shown in FIGS. 3, 6 and 7. The support piece 9*c* is structured in an approximately thin semicircular shape and in a circular arc surface capable of supporting the stick-shaped cosmetic material M on the inner peripheral surface, as shown in FIG. 3, and the rear end portion of the stick-shaped cosmetic material M is fitted to the portion between these four support pieces 9*c* and 9*c* so as to be held, as shown in FIGS. 1 and 2.

In this case, a protrusion 9*g* extending in an axial direction is provided in an inner surface of each of the support pieces 9*c*, as shown in FIG. 3. The protrusion 9*g* is structured such as to increase a contact area with the stick-shaped cosmetic material M, increase a frictional resistance, inhibit the stick-shaped cosmetic material M from rotating, and securely support the stick-shaped cosmetic material M.

The forward and backward moving hole 8*d* of the front tube 8 mentioned above which receives the stick-shaped cosmetic material M and the support piece 9*c* and along which the stick-shaped cosmetic material M and the support piece 9*c* move forward and backward is formed in a non-circular shape close to the stick-shaped cosmetic material M and the support piece 9*c*, and is structured in a curved shape in which the connection portion between the through hole 8*b* and the groove 8*c* is connected in a round surface shape. In this forward and backward moving hole 8*d*, the gap between the stick-shaped cosmetic material M and the forward and backward moving hole 8*d* (the surface between the grooves 8*c* and 8*c* of the through hole 8*b*) is made small, and the gap between the support piece 9*c* and the forward and backward moving hole 8*d* (the groove 8*c*) is made small. In this case, the forward and backward moving hole 8*d* is structured, as shown in FIG. 2, such that the leading end surface is set to a forward movement limit of the support rod 9 with which the leading end surface of the support rod 9 is brought into contact.

Figure 8:
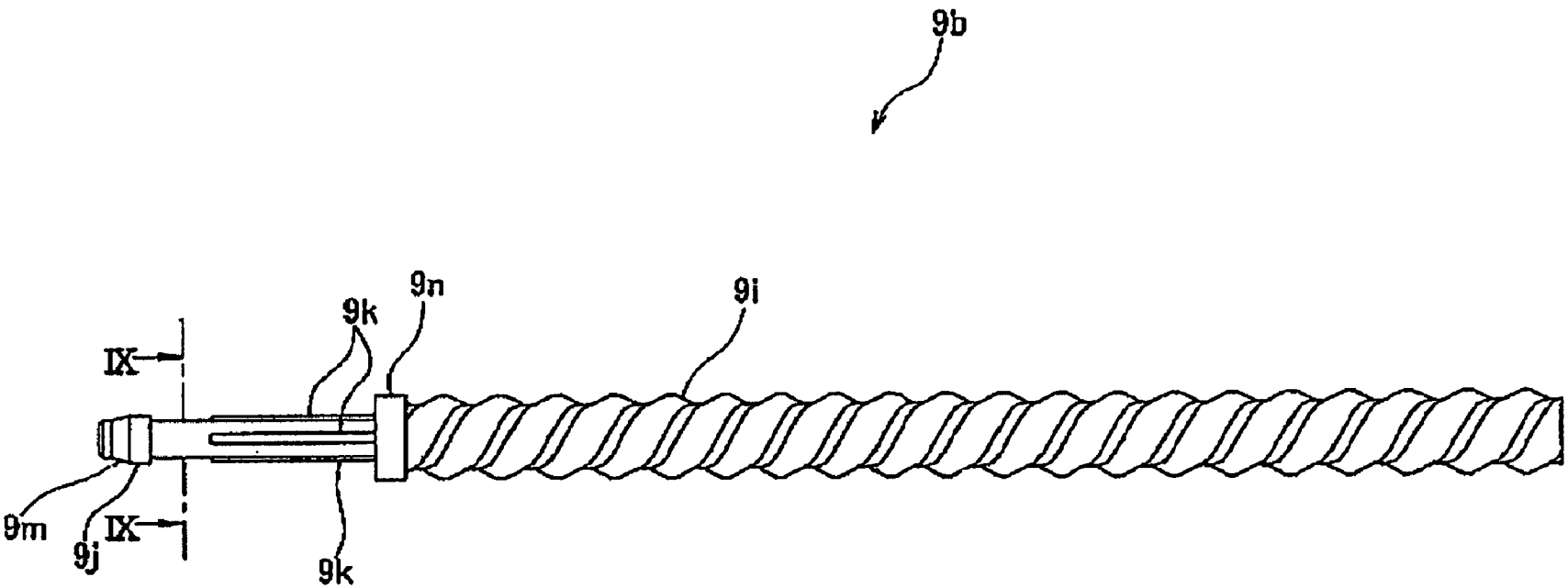
FIG. 8 is a side view of a shaft body portion of the support rod shown in FIG. 6.

Further, the shaft body portion 9*b* constituting the support rod 9 is provided with a collar portion 9*n* at a position which is a predetermined length apart from the connection portion 9*m* to the rear side, as shown in FIGS. 1, 2, 7 and 8, and is provided with a spiral groove 9*i* constituting the engagement mechanism from the collar portion 9*n* to the rear end, as shown in FIGS. 1, 2 and 5 to 8. An annular protruding portion 9*j* is formed in the outer peripheral surface of the connection portion 9*m* as shown in FIGS. 7 and 8.

Figure 9:
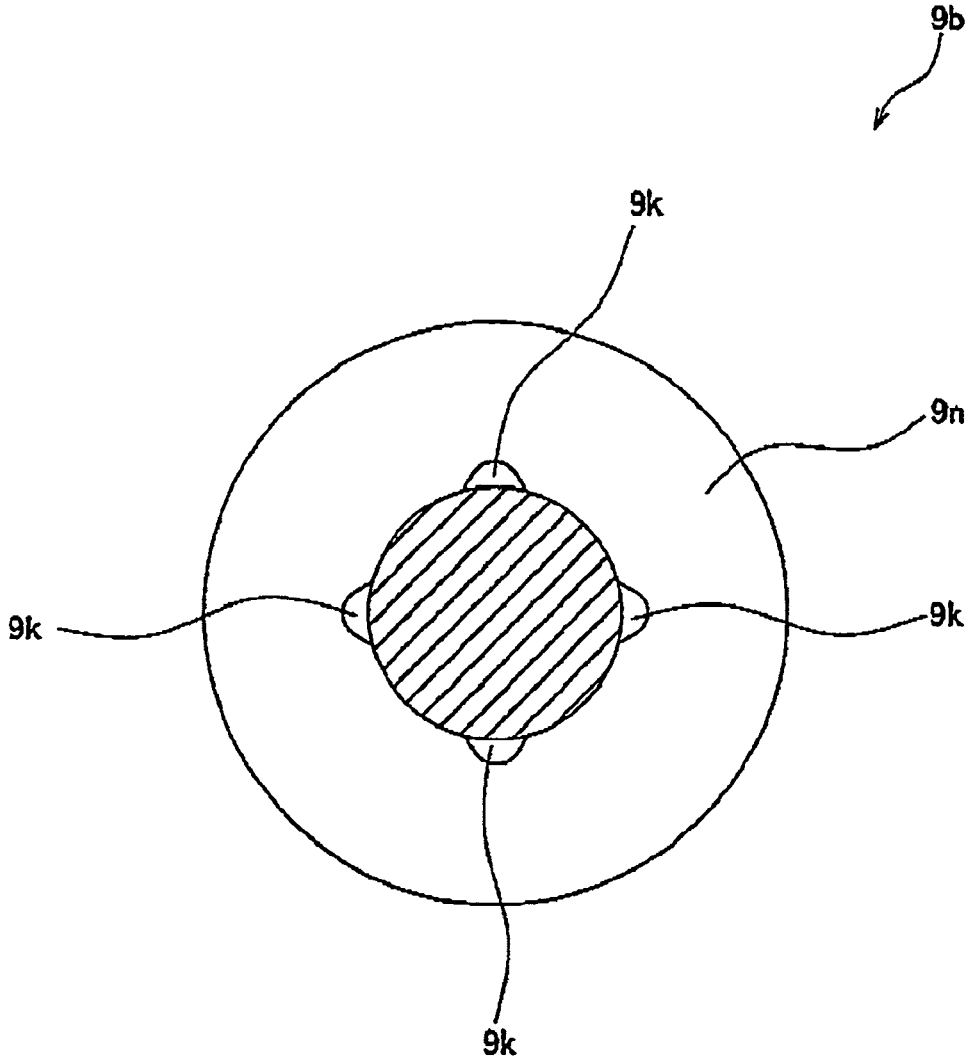
FIG. 9 is a view as seen from a line IX—IX in FIG. 8.

A packing attachment portion is formed between the connection portion 9*m* and the collar portion 9*n* in the shaft body portion 9*b*, and a protrusion 9*k* for attaching a packing 10 is provided at four uniformly arranged positions (at an interval of 90 degree) in the peripheral direction of the outer peripheral surface, in the packing attachment portion, as shown in FIGS. 7 to 9, so as to extend in the axial direction.

The packing 10 is provided, as shown in FIGS. 10 and 11, with a through hole 10*a* extending through in the axial direction and having a gear cross sectional shape in a center of the packing 10, an outer shape thereof copies the non-circular shape of the forward and backward moving hole 8*d*, and in particular, an outer shape of the center portion in the axial direction copies the noncircular shape of the forward and backward moving hole 8*d* and is slightly larger than the outer shape of the forward and backward moving hole 8*d*, thereby being formed as a slidable contact portion 10*b*.

The packing 10 structured in the manner mentioned above is outward inserted to the packing attachment portion from the connection portion 9*m* of the shaft body portion 9*b*, as shown in FIGS. 5 to 7, the protrusion 9*k* of the shaft body portion 9*b* moves forward to and is engaged with a plurality of grooves 10*c* (eight groove portions in the present embodiment) constituting the gear shape of the packing 10, and the rear end surface of the packing 10 is brought into contact with the collar portion 9*n* of the shaft body portion 9*b*, thereby being connected to the packing attachment portion of the shaft body portion 9*b* so as to be synchronously rotatable (not to be relatively rotatable). The groove portion 10*c* constituting the gear shape of the packing 10 and the protrusion 9*k* of the shaft body portion 9*b* are structured such that when a predetermined rotational force or more is applied, the protrusion 9*k* climbs over the protrusion in the opposite side and the engagement thereof is cancelled.

The shaft body portion 9*b* having the structure mentioned above (the member to which the packing 10 is attached) is structured, as shown in FIG. 7, such that the connection portion 9*m* is inward inserted to the recess portion 9*e* of the base portion 9*d*, and the annular protruding portion 9*j* of the connection portion 9*m* is engaged with the annular groove portion 9*f* of the recess portion 9*e*, thereby being rotatably attached to the support portion 9*a* (the member in which the support piece 9*c* is arranged), and the packing 10 is attached to the packing attachment portion so as to be unmovable in the axial direction, whereby the support rod 9 shown in FIGS. 6 and 7 is obtained.

The support rod 9 is structured, as shown in FIG. 1, such that the support piece 9*c* is inward inserted to the forward and backward moving hole 8*d* so as to move forward to the groove 8*c* of the front tube 8, and on the other hand, the shaft body portion 9*b* is inward inserted to the small-diameter hole of the main body tube 7, and the spiral groove 9*i* of the shaft body portion 9*b* and the engagement projection 7*c* of the main body tube 7 are set in the engaged state.

In this state, since the noncircular slidable portion 10*b* of the packing 10 is made slightly larger than the outer shape of the noncircular forward and backward moving hole 8*d*, the noncircular slidable portion 10*b* is made synchronously rotatable (relatively non-rotatable) with the noncircular forward and backward moving hole 8*d* so as to structure the synchronous rotation mechanism (a rotation preventing mechanism) of the forward and backward moving mechanism, and is pressure contacted with the forward and backward moving hole 8*d*, whereby the space in the leading end side from the packing 10 is made airtight with respect to the space in the rear end side from the packing 10.

Further, the cap 5 is formed by a flexible material, for example, a synthetic resin or the like, is provided, as shown in FIG. 1, with an annular elastic protruding portion 5*a* which is formed in a closed-end tubular shape and serves as an airtight portion protruding to an open end side, in an inner surface of a bottom portion, as shown in FIGS. 1 and 3, with a lot of concavo-convex portions 5*b* which are arranged along an inner peripheral surface in an open end side and extend at a predetermined length in an axial direction, and as shown in FIG. 1, with an annular groove 5*c* which is arranged in an inner peripheral surface in the bottom portion side from the concavo-convex portion 5*b*. The cap 5 is outward inserted to a portion protruding from the receiving container 2 in the main body tube 7, the opening end surface is brought into contact with the leading end surface of the collar portion 7*a* of the main body tube 7, and the protrusion 7*e* of the main body tube 7 moves forward to and is engaged with the concavo-convex portion 5*b* of the cap 5, as shown in FIG. 3. Accordingly, the cap 5 is connected to the main body tube 7 so as to be relatively non-rotatable. Further, as shown in FIG. 1, the protruding portion 7*f* of the main body tube 7 is engaged with the annular groove portion 5*c* of the cap 5, whereby the cap 5 is detachably mounted to the main body tube 7, the outer peripheral surface of the leading end portion of the front tube 8 is pressure contacted with the inner peripheral surface of the leading end portion in the elastic protruding portion 5*a* of the cap 5 under this state, and the space between the elastic protruding portion 5*a* of the cap 5 and the packing 10 is made airtight.

In the stick-shaped cosmetic material feeding container 1 mentioned above, when relatively rotating the front tube 8 and the receiving container 2 in a state in which the cap 5 is taken out and detached from the main body tube 7 such that the engagement between the annular groove portion 5*c* of the cop 5 and the protruding portion 7*f* of the main body tube 7 is released, the stick-shaped cosmetic material M and the support rod 9 well move forward and backward along the forward and backward moving hole 8*d* while the slidable portion 10*b* of the packing 10 is in slidable contact with the forward and backward moving hole 8*d* in an air tight manner, on the basis of an effect obtained by the engagement mechanism constituted by the spiral groove 9*i* of the support rod 9 and the engagement projection 7*c* of the main body tube 7, and the synchronous rotating mechanism constituted by the slidable portion 10*b* of the packing 10 in the support rod 9 and the forward and backward moving hole 8*d* of the front tube 8, whereby the stick-shaped cosmetic material M well comes out and return from the leading end of the front tube 8. Accordingly, it is possible to sufficiently achieve the function for the stick-shaped cosmetic material feeding container 1.

At this time, since the shaft body portion 9*b* in the support rod 9, to which the packing 10 is attached, and the support portion 9*a*, in which the support piece 9*c* is arranged, are rotatably connected via the connection portion 9*m*, the rotational torque applied to the packing 10 on the basis of the relative rotation is shut off with respect to the support piece 9*c*, it is possible to prevent the torsional force from being applied to the stick-shaped cosmetic material M supported by the support piece 9*c*, and it is possible to prevent the stick-shaped cosmetic material M from being broken.

When the support rod 9 reaches the forward movement limit/backward movement limit, and further continues the relative rotation, the predetermined rotating force or more is applied to the groove portion 10*c* of the packing 10 and the protrusion 9*k* of the shaft body portion 9*b*, the protrusion 9*k* climbs over the protrusion in the opposite side, the engagement thereof is cancelled and the protrusion 9*k* idle rotates, whereby the synchronous rotation between the front tube 8 and the support rod 9 is cancelled. Accordingly, it is possible to prevent the support rod from being broken due to the unreasonable rotation, and a predetermined resistance feeling is given on the basis of the protrusion 9*k* climbing over the protrusion in the opposite side, whereby it is possible to feel reaching the forward movement limit or the backward movement limit.

In the case that it is desired to take out the stick-shaped cosmetic material cartridge 3 from the receiving container 2 so as to use, or in the case that it is necessary to replace the stick-shaped cosmetic material M due to consumption and take out the stick-shaped cosmetic material cartridge 3 from the receiving container 2, the cap 5 and the receiving container 2 are relatively rotated in a state in which the cap 5 is attached to the main body tube 7. Then, in the cap 5 and the main body tube 7, since the concavo-convex portion 5*b* of the cap 5 and the protrusion 7*e* of the main body tube 7 are engaged and connected so as to be non-rotatable, the engagement between the male screw 7*b* of the main body tube 7 and the female thread 2*b* of the receiving container 2 is cancelled. When the engagement is cancelled as mentioned above, the stick-shaped cosmetic material cartridge 3 is taken out from the receiving container 2 together with the cap 5 so as to detach the cap 5, and the front tube 8 and the main body tube 7 are relatively rotated. Then, in the same manner as the case that the stick-shaped cosmetic material cartridge 3 is attached to the receiving container 2, the stick-shaped cosmetic material M and the support rod 9 moves forward and backward in the forward and backward moving hole 8*d*, and the stick-shaped cosmetic material M comes out from the leading end of the front tube 8. As mentioned above, it is possible to independently use the stick-shaped cosmetic material cartridge 3 as a stick-shaped cosmetic material feeding container. In the case that the stick-shaped cosmetic material cartridge 3 is attached to the receiving container 2, the inverse operation to the operation mentioned above is executed.

Further, in the case that the external force is applied by drop or the like is applied to the stick-shaped cosmetic material feeding container 1 or the stick-shaped cosmetic material cartridge 3, since the gap of the stick-shaped cosmetic material M with respect to the forward and backward moving hole 8*d* (the surface between the grooves 8*c* and 8*c* of the through hole 8*b*) is made small the stick-shaped material M is supported by the forward and backward moving hole 8*d* (the surface between the grooves 8*c* and 8*c* of the through hole 8*b*) before being bent and broken, whereby the stick-shaped cosmetic material M is prevented from being broken due to bend, and an excellent quality is secured.

Further, since the space in the leading end side from the packing 10 is made airtight with respect to the space in the rear end side from the packing 10 by the packing 10, and the space between the elastic protruding portion 5*a* of the cap 5 and the packing 10 is made airtight by the cap 5 and the packing 10 at a time of attaching the cap 5, the volatile stick-shaped cosmetic material M is well prevented from being volatilized, and an excellent quality is secured.

Figure 12:
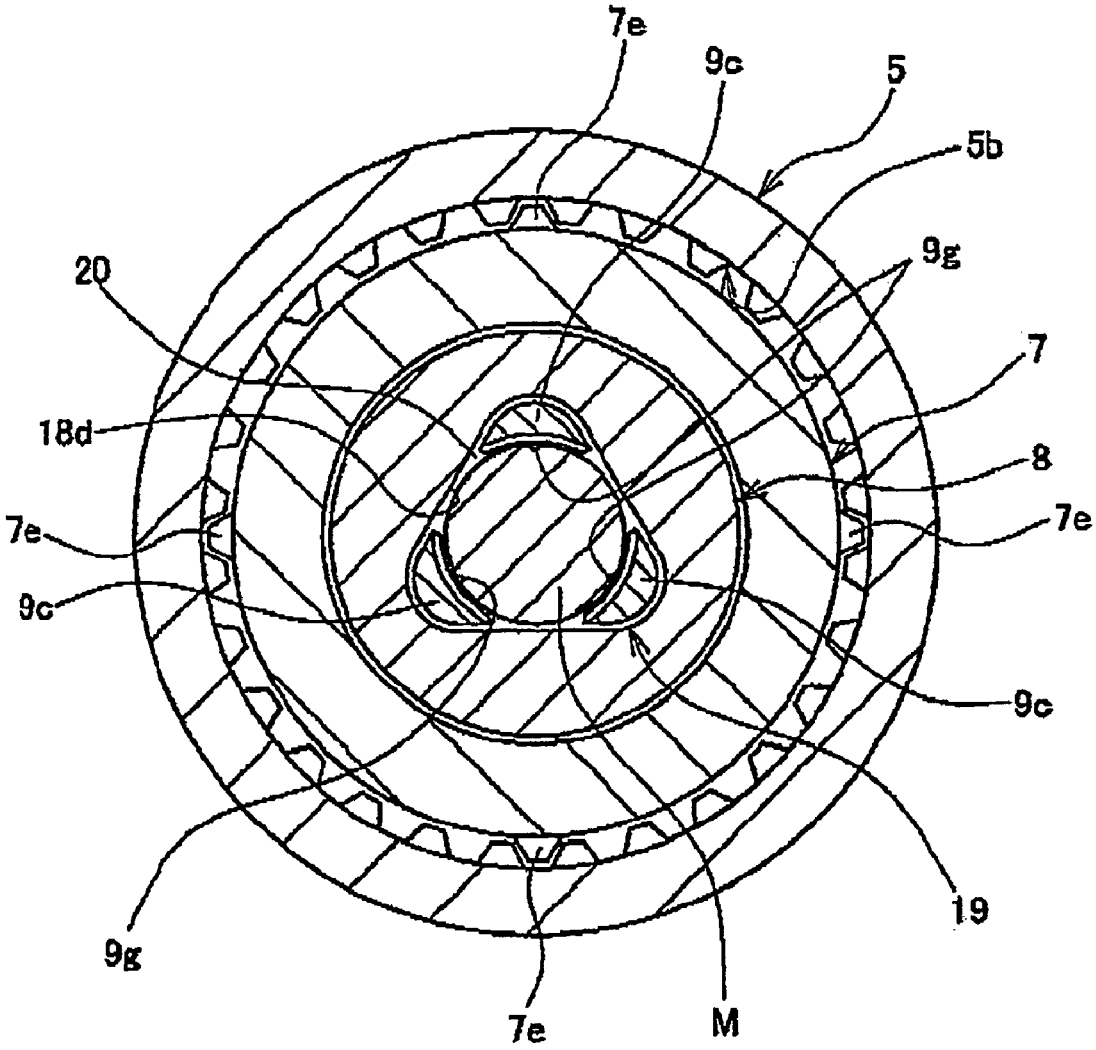
FIG. 12 is a cross sectional view showing a stick-shaped cosmetic material feeding container in accordance with a second embodiment of the present invention, and a view corresponding to a view as seen from a line III—III in FIG. 1.
Figure 13:
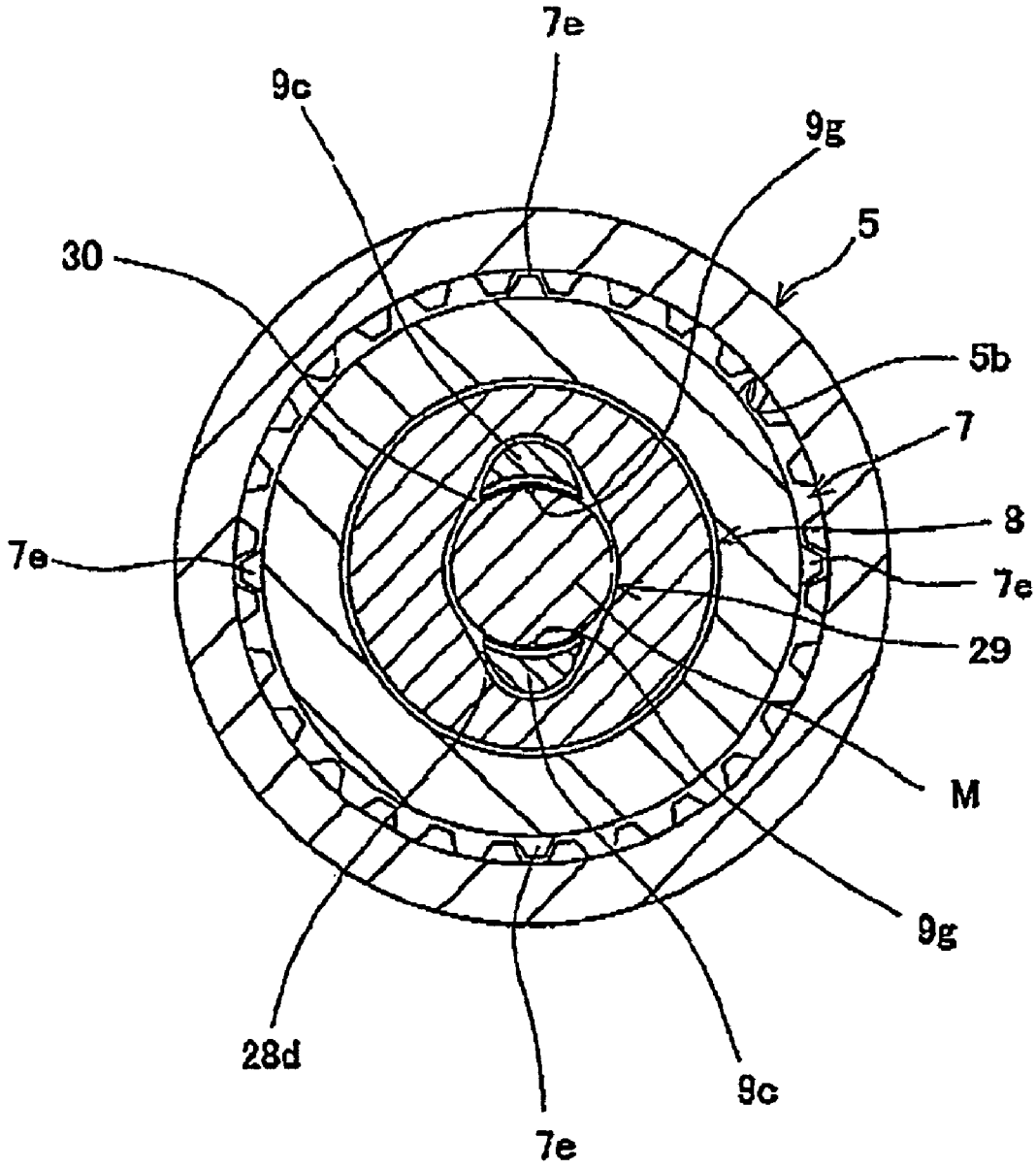
FIG. 13 is a cross sectional view showing a stick-shaped cosmetic material feeding container in accordance with a third embodiment of the present invention, and a view corresponding to a view as seen from a line III—III in FIG. 1.

FIG. 12 is a cross sectional view showing a stick-shaped cosmetic material feeding container in accordance with a second embodiment of the present invention, and a view corresponding to a view as seen from a line III—III in FIG. 1, and FIG. 13 is a cross sectional view showing a stick-shaped cosmetic material feeding container in accordance with a third embodiment of the present invention, and a view corresponding to a view as seen from a line III—III in FIG. 1.

These embodiments are different from the first embodiment in points that the second embodiment employs three support pieces 9*c*, and the third embodiment employs two support pieces 9*c*.

In these embodiments, the support rods 19 and 29 provided with the support piece 9*c* are provided with the support pieces 9*c* in the uniformly arranged positions in the peripheral direction in the same manner as the first embodiment. On the other hand, the groove along which the support piece 9*c* moves forward and backward is continuously provided in the through hole through which the stick-shaped cosmetic material M moves forward and backward, and forward and backward moving holes 18*d* and 28*d* close contacted with the stick-shaped cosmetic material M and the support piece 9*c* are formed in a noncircular shape having an approximately triangular cross section having a round corner portion in the second embodiment, and in a noncircular shape having an approximately oval horizontal cross section in the third embodiment. Further, packings 20 and 30 copying the forward and backward moving holes 18*d* and 28*d* and pressure contacted therewith are formed in an approximately triangular shape having a round corner portion and in an approximately oval shape.

In the second embodiment and the third embodiment mentioned above, it is needless to say that the same operations and effects as those of the first embodiment can be achieved.

In the case that the number of the support pieces 9*c* is set to be five or more, the arrangement of the support piece 9*c* and the shapes of the forward and backward moving hole and the packing may be changed in the same manner as the embodiment mentioned above.

A description is specifically given above of the present invention on the basis of the embodiments, however, the present invention is not limited to the embodiments mentioned above. For example, in the embodiments, the present invention is applied to the circular stick-shaped cosmetic material M, however, may be applied to an oval stick-shaped cosmetic material.

Further, the spiral groove, the engagement projection, the female thread and the male screw in accordance with the present embodiment may be structured as a screw-type elements having the same function.

Further, the present invention can be applied, for example, to a stick-shaped cosmetic material feeding container as described in Japanese Utility Model Publication No. 59-17210. This stick-shaped cosmetic material feeding container is structured such that the stick-shaped cosmetic material feeding container is provided with a front tube and a main body tube rotatably connected to a rear end side of the front tube (actually connected rotatably via an intermediate tube), that the front tube is provided with a forward and backward moving hole which receives a support piece supporting a stick-shaped cosmetic material and allows the support piece to move forward and backward, that the main body tube is provided with a female thread which extends in an axial direction in an inner peripheral side thereof, that a pressing rod arranged in a rear side of a support rod provided with the support piece is received in the main body tube, that a protruding portion provided in a rear end portion of the pressing rod is engaged with the female thread in an inner peripheral side of the main body tube so as to structure an engagement mechanism, that when relatively rotating the front tube and the main body tube, the pressing rod moves forward and backward in accordance with a motion of the engagement mechanism, the support rod is pressed by the forward moving pressing rod and the stick-shaped cosmetic material protrudes from a leading end of the front tube, that when relatively rotating the front tube and the main body tube in an inverse direction, the pressing rod moves backward in accordance with the motion of the engagement mechanism, the support rod is drawn back to the original position within the front tube on the basis of an operation of a return spring locked to the support rod and the stick-shaped cosmetic material is sunk in from a leading end of the front tube, and that when taking out the front tube from the main body tube, the support rod is drawn back to the original position within the front tube on the basis of the operation of the return spring and the stick-shaped cosmetic material is sunk in from the leading end of the front tube. Further, the present invention can be applied, for example, to a stick-shaped cosmetic material feeding container as described in Japanese Patent Publication No. 3-71121. This stick-shaped cosmetic material feeding container is structured such that the stick-shaped cosmetic material feeding container is provided with a front tube provided with a slit pipe in a rear half portion and a main body tube receiving the slit pipe portion in the front tube and rotatably connected to the front tube, that the front tube is provided with a forward and backward moving hole which receives a support piece supporting a stick-shaped cosmetic material and allows the support piece to move forward and backward, that a protruding portion provided in a rear end portion of the support rod provided with the support piece protrudes to an outer side through a slit of a slit pipe, the protruding portion is engaged with a screw portion such as a female thread formed in an inner peripheral side of the main body tube and extending in an axial direction, a spiral groove and the like so as to structure an engagement mechanism, and that when relatively rotating the front tube and the main body tube, the support rod moves forward and backward in accordance with a motion of the engagement mechanism and the stick-shaped cosmetic material protrudes from a leading end of the front tube. In any of these cases, the support piece, the forward and backward moving hole and the packing can be provided in the same manner as the embodiment mentioned above, and in short, various structures can be employed as the forward and backward moving mechanism of the support rod.

What is claimed is:

1. A stick shaped cosmetic material feeding container comprising:

a support rod supporting a rear end portion of a stick-shaped cosmetic material;

a front tube receiving said stick-shaped cosmetic material and said support rod in a forward and backward moving hole so as to freely move forward and backward;

a main body tube rotatably connected to a rear end side of the front tube;

said front tube and said support rod being synchronously rotatable, said support rod being moved forward and backward in said forward and backward moving hole in accordance with a motion of an engagement mechanism on the basis of a relative rotation of said front tube and said main body tube and thereby said stick-shaped cosmetic material coming out and returning from a leading end of said front tube, wherein said support rod is provided with a plurality of support pieces which are arranged apart from each other in a peripheral direction and support the rear end portion of said stick shaped cosmetic material, wherein said forward and backward moving hole is provided with grooves adapted for forward and backward movement of said support pieces at a plurality of positions in the periphery of a through hole adapted for forward and backward movement of said stick shaped cosmetic material, and an inner surface of the forward and backward moving hole is formed in a noncircular shape coming close to said stick-shaped cosmetic material and said support pieces, wherein said support rod is provided with a packing attached at a rear side of said support pieces so as to be synchronously rotatable and immovable in an axial direction, and wherein an outer shape of said packing is formed in a shape copying said noncircular shape of said forward and backward moving hole and being pressure contacted with said forward and backward moving hole so that a space at the side of said stick-shaped cosmetic material is made to be airtight with respect to a space at the side of the rear end of said support rod.

2. A stick shaped cosmetic feeding container as claimed in claim 1, wherein an inner peripheral surface of said packing and an outer peripheral surface of said support rod are structured in such a shape that when said support rod reaches a forward movement limit or a backward movement limit said packing and said support rod run idle with a predetermined resistance feeling on the basis of said relative rotation.

3. A stick-shaped cosmetic material feeding container as claimed in claim 2, wherein said support rod is separated into a member in which said support pieces are arranged and a member to which said packing is attached and is structured such that both the members are connected rotatably.

4. A stick shaped cosmetic material feeding container as claimed in claim 1, wherein said support rod is separated into a member in which said support pieces are arranged and a member to which said packing is attached and is structured such that both the members are connected rotatably.

* * * * *